United States Patent [19]

Vanderlinden

[11] Patent Number: 5,058,510

[45] Date of Patent: Oct. 22, 1991

[54] GRAVITY DISCHARGE HOPPER GATE ASSEMBLY

[75] Inventor: Richard J. Vanderlinden, Rochester Hills, Mich.

[73] Assignee: Trinity Industries, Inc., Dallas, Tex.

[21] Appl. No.: 522,165

[22] Filed: May 11, 1990

[51] Int. Cl.[5] ..... B67D 5/60

[52] U.S. Cl. ..... 105/282.2; 105/424

[58] Field of Search ..... 105/280, 282.2, 282.3, 105/282.1, 424; 49/209; 222/559, 561, 310, 504

[56] References Cited

U.S. PATENT DOCUMENTS

| | | | |
|---|---|---|---|
| 2,112,698 | 3/1938 | Hull | 105/282.2 |
| 2,989,008 | 7/1961 | Lindstrom | 105/282.3 |
| 3,100,457 | 8/1963 | Dorey | 105/282.1 |
| 4,785,966 | 11/1988 | Waltke | 222/559 |

*Primary Examiner*—Robert J. Oberleitner
*Assistant Examiner*—Mark T. Le
*Attorney, Agent, or Firm*—Myers & Assoc., Ltd.

[57] ABSTRACT

A gate assembly for closing and opening a bottom discharge opening of a railway car hopper, the gate assembly comprising upper and lower plates with cooperating wedges thereon wherein the hopper is provided with an elastomeric sealing ring about the discharge opening and the lower plate moves the upper plate evenly upwardly against the sealing ring, the wedges being spread over extensive vertically aligned areas of the plates so that upper plate is urged evenly upwardly into sealing contact about its borders with the sealing ring.

16 Claims, 2 Drawing Sheets

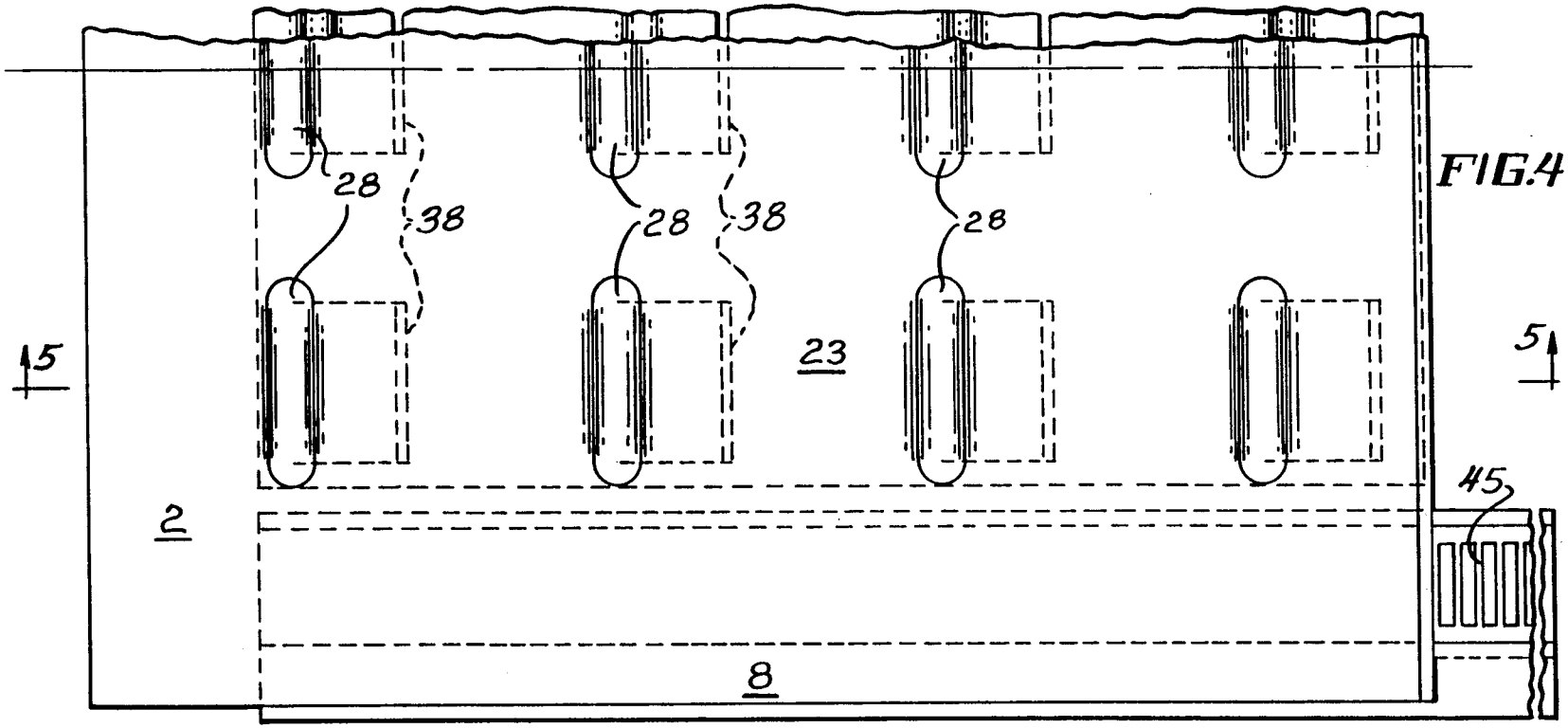
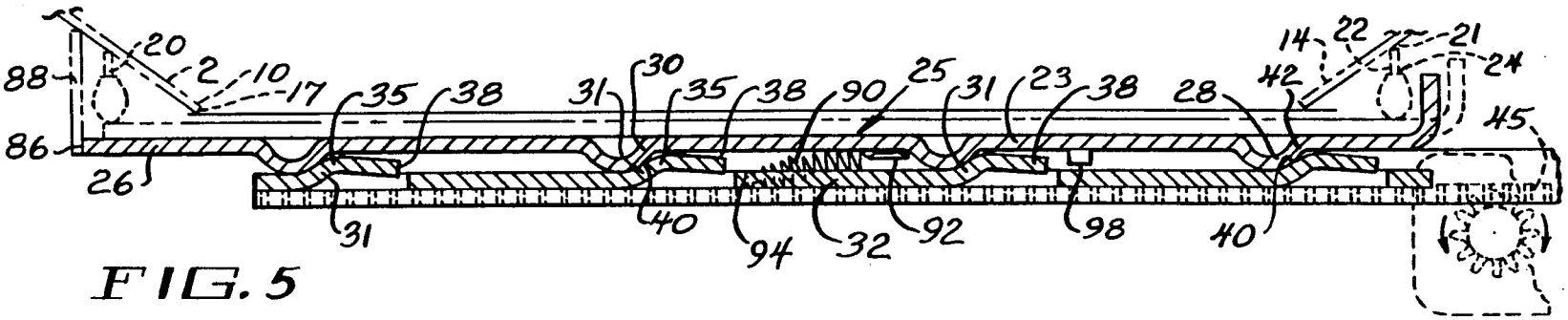
FIG. 5

GRAVITY DISCHARGE HOPPER GATE ASSEMBLY

BACKGROUND OF THE INVENTION

This invention relates to hoppers particularly adapted to railway cars. In railway hopper cars there are provided gates for closing and opening the discharge outlet at the lower end of the hopper. Various types of gates or closures have been proposed and used to close off the discharge outlet. The primary difficulty has been in controlling seepage of product especially of particulate product such as alumina which is difficult to contain.

The present invention discloses a hopper with a bottom opening which is closed by a gate assembly having superposed upper and lower plates with their interfaces provided with cooperating wedges serving to lift the upper plate to closing position with the discharge opening against an encompassing sealing strip supported on a marginal edge portion of the hopper.

DISCUSSION OF THE PRIOR ART

The following patents are discussed showing the general state of art:

U.S. Pat. No. 2,989,008 discloses a plate assembly comprising upper and lower plates with an intervening pad of elastomeric material and the lower plate rides on an inclined wall to raise the assembly to closed position.

U.S. Pat. No. 3,106,899 also shows a rack and pinion drive plate which rides up a ramp to close.

U.S. Pat. No. 3,621,793 illustrates a plate assembly which is sealed along the edges of the hopper by spring plates.

U.S. Pat. No. 4,253,400 shows a rack and pinion drive for moving the hopper gate between open and closed position, the gate being lifted and lowered by levers.

SUMMARY OF THE INVENTION

A general object of the invention is to provide an improved hopper car discharge gate assembly particularly adapted for use in transporting finely powered lading.

Another object is to provide a gate assembly for railway hopper cars capable of effectively sealing the hoppers when closed.

A further object is to provide a gate assembly having two superposed plates which have a wedging action therebetween for lifting the upper plate to sealing position.

A different object is to provide a novel arrangement of wedges on the bottom of a top plate cooperating with wedges on the bottom plate such that initially the top plate follows the lower plate in moving endwise to closed position relative to the hopper and then lifting the upper plate to sealed closing position in engagement with a sealing strip carried from the bottom edge portion of the hopper walls.

The invention comprehends the provision of a hopper gate in which a pair of superposed plates are used comprising upper and lower plates with intervening cooperating wedges formed on the bottom and top of the lower and upper panels covering substantially the full opposing areas thereof so as to lift the upper plate evenly over its entire extent to provide good sealing capability between the upper plate and the superposed perimetrical sealing strip on the hopper overlapping edges of the top plate.

The invention further contemplates a novel hopper gate which utilizes a return spring arrangement which reacts between the two plates to hold the lower plate which incorporates a rack in close coupled relation with the teeth of the driving pinion to prevent the parts from rattling and working loose and thus prevent the upper plate from shaking and cracking open the seal between the elastomeric strip and the top plate which could cause seepage of the material in the hopper especially if the lading is in powder form.

Another object is to devise a gate arrangement in which the upper plate is stamped to provide a series of wedges and the deformation also increasing the transverse strength of the plate.

These and other objects and advantages inherent in and encompassed by the invention will become more apparent from the specification and drawings, wherein:

FIG. 4 is an enlarged fragmentary top plan view; and

FIG. 5 is a cross section taken substantially on line 5—5 of FIG. 4.

DESCRIPTION OF THE INVENTION

Figure 1:
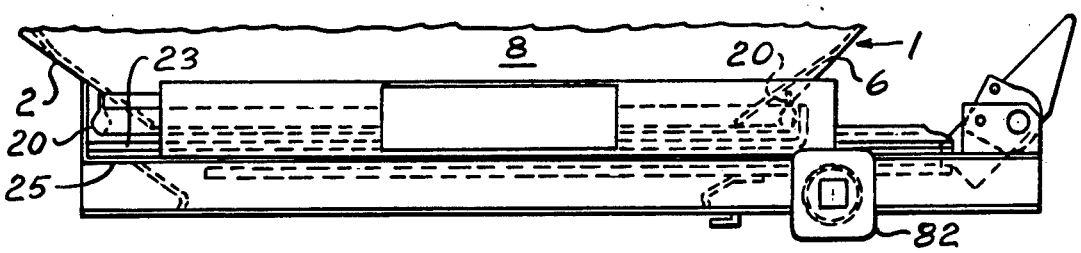
FIG. 1 is a side elevational view of the novel hopper assembly and gate.

The hopper assembly 1 which is adopted to be mounted to a hopper railway car in usual manner comprises four edge-connected side walls 2, 4, 6 and 8 which slope downwardly inwardly and provide lower edge portions 10, 12, 14 and 16 defining a bottom outlet opening 17 for discharging the lading.

A perimetrical continuous sealing edging generally designated 20 is mounted beneath the lower edge portions 10–16 and comprises a vertical metal strip 22 which is welded or otherwise secured at 21 to the edge portion thereabove, the lower portion of the strip 22 is embedded into an endless chord 24 of elastomeric material which is of bulbous shape in cross-section. The material is resilient and compressible such as neoprene and seals against an opposing perimetrical or border portion 26 of an upper plate 23 of a gate assembly generally designated 25.

The upper plate 23 is generally flat and has indentations 28 at spaced lateral as well as longitudinal locations. These indentations which cover the major portion of the plate are preferably of semi-cylindrical shape and terminate as opposite ends in speriodal forms.

The indents or depressed formations provide on their lower edges wedge surfaces 30.

A bottom plate 32 of the gate assembly has a series of upwardly offset projections 85 equal in member with the indents and in vertical alignment with the respective thereof.

Each projection, being a wedge is formed by cutting it out on three sides from the lower plate and has a upwardly slanted forward wedge portion 31 and a tail section 38 extending parallel with plate 32 and offset upwardly therefrom.

The front foil of each tab or riser 38 provides a wedge surface 40 which engages with the back side 42 of the adjacent wedge 28 for urging the top plate to closed position which is accomplished by a rack and pinion drive 45 which comprises a rack strips 46, 48 fixed as by welding to the side edge portions 50, 52 of the bottom plate by way of flanges 56, 58 extending laterally from the toothed portions of the respective racks.

The flange portions 56, 58 ride upon upper webs 60, 62 of longitudinal horizontal box section beams 64, 66. The upper flanges 56,58 are connected to the lower edges of vertical hanger webs which extend to the adjacent side wall of the hopper and are welded thereto.

The racks cooperates with pinions 72, 74 mounted on and driven from a common shaft 75 which is journaled adjacent to its opposite ends in bearings 76, 78 carried within the beams 64, 66. The ends of the shaft are provided with couplings or heads 80, 82 which are adopted to be turned by suitable tool bars or by hand extended through apertures 85 in respective heads.

In operating the gate, the lower plate is driven forwardly (a term used arbitrarily) which wedges the upper plate upwardly upon the loading edge 86 of the upper plate engaging the stop 88 which depends from a side wall of the hopper.

The upper plate upon rising engages the gasket or seal to maintain the upper plate tightly thereagainst.

A tension spring 90 is attached at one end to the upper plate as at 92 and at its other end as at 94 to the lower plate.

This spring pulls the upper plate back off the lower plates wedges 38 toward an unwedging position. It also holds the plates together as one unit until the upper plate hits the forward frame stop. When the upper plate contacts the forward frame stop the lower plate has not. The lower plate keeps traveling forward toward the frame raising the upper plate on the wedges, against the spring.

As best seen in FIG. 5 a stop 98 is provided on the upper plate for engagement with the tail portion 38 of an adjacent wedge so that the two plate move together in a retracting direction.

Figure 2:
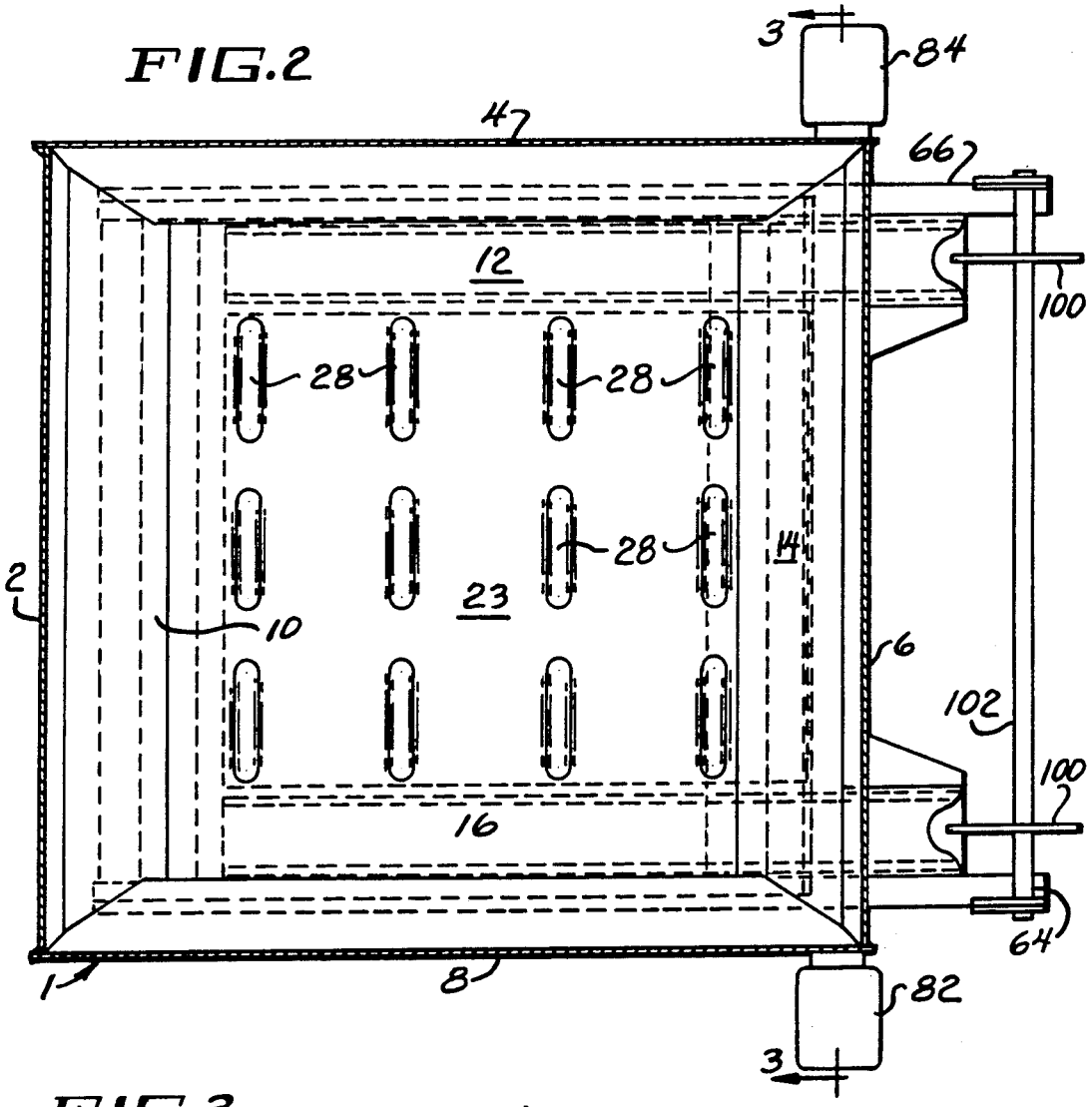
FIG. 2 is a top plan view.
Figure 3:
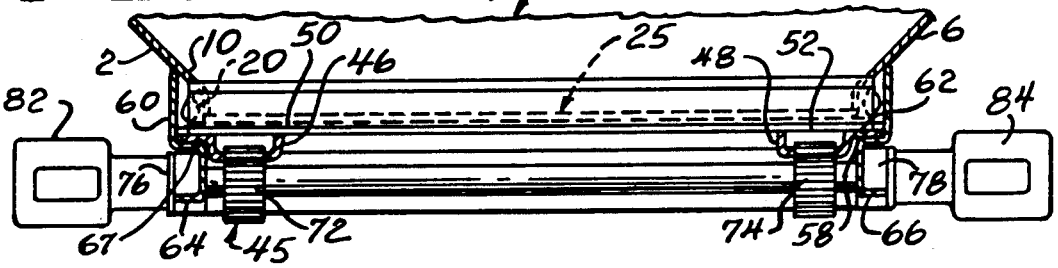
FIG. 3 is a cross section taken substantially on line 3—3 of FIG. 2.

The plates are held locked in closed position by latch plates 100 which are mounted on a support shaft 102 rotatably carried on the ends of the beams or tracks 64, 66. The latches are shown in locking position in FIGS. 1 and 2. They are rotated clockwise upwardly (FIG. 1) to unlatch.

In ending up over the wedges on the lower plate, the upper plate over compresses the gasket slightly. Then goes down the other side of the lower plate wedge a little ways. This over center lock keeps the gate closed against spring force which wants to pull it back down on the lower plate.

I claim:

1. A hopper for a railway car comprising a discharge chute having downwardly converging interconnected walls defining a discharge opening, a gate comprising a pair of superposed plates comprising upper and lower plates with intervening cooperating wedge means on said plates, and means for motivating the lower plate for movement in a wedging and closing direction to close said gate, and spring means for biasing said plates in an unwedging direction.

2. A hopper for a railway car comprising a discharge chute having downwardly converging interconnected walls defining a discharge opening, a gate comprising a pair of superposed plates comprising upper and lower plates with intervening cooperating wedge means on said plates, and means for motivating the lower plate for movement in a wedging and closing direction to close said gate, and in which said wedging means comprises a plurality of wedge members on said top plate and corresponding wedge members on the lower plate posted about the entire area of each plate for essentially uniformly lifting and lowering the top plate without warping into closed and open positions.

3. The invention according to claim 2, and sealing means bordering said opening positioned for engagement with said top plate.

4. The invention according to claim 3, and spring means interposed between the plates for biasing the plates into a wedging disengaging position.

5. A discharge gate assembly for a railway car hopper for transporting powdered lading comprising a gate frame mounted on the hopper of said car beneath a discharge opening thereof, sealing means bordering said opening, said frame comprising a pair of side rails, said gate assembly comprising superposed upper and lower plates carried by said side rails, means for driving said lower plate between closed and open positions relative to said opening, wedge means formed on said plates in cooperative engagement with each other for moving the upper plate with said lower plate to closed position through said wedge means and for lifting the upper plate to a sealed position with said sealing means, spring means interconnecting said plates and biasing them to an unwedging position.

6. The invention according to claim 5, and said spring means comprising a tension spring.

7. A discharge gate assembly for a railway car hopper for transporting powdered lading comprising a gate frame mounted on the hopper of said car beneath a discharge opening thereof, sealing means bordering said opening, said frame comprising a pair of side rails, said gate assembly comprising superposed upper and lower plates carried by said side rails, means for driving said lower plate between closed and open positions relative to said opening, wedge means formed on said plates in cooperative engagement with each other for moving the upper plate with said lower plate to closed position through said wedge means and for lifting the upper plate to a sealed position with said sealing means, and, said wedge means comprising a plurality of depressed portions of the top plate and upward projections on the bottom plate positioned in a geometric pattern for engagement with each other.

8. A hopper for a railway car comprising downwardly converging panels defining a discharge opening, a gate assembly supported from said hopper beneath said opening and having a pair of superposed first and second gate plates, wedge means spread about a major extent of said plates within marginal borders thereof, said means comprising mating projections extending from the plates toward each other in wedging engagement for lifting the upper plate, and sealing means carried by the panels of the hopper about said opening and engageable with the borders of said upper plate attendant to lifting thereof.

9. The invention according to claim 8, and spring means interconnecting said plates and biasing the same into unwedging disengagement of said wedge means thereon.

10. The invention according to claim 9, and said spring means comprising a tension spring.

11. The invention according to claim 8, and said sealing means disposed below the ends of the hopper panels in vertical alignment with said borders.

12. The invention according to claim 9, and means for effecting movement of said lower plate against the tension of said spring means.

13. The invention according to claim 9, and a rack and pinion drive operatively connected to said lower plate for engaging to disengaging said wedge means, and stop means for limiting retracting movement of said lower plate with respect to the upper plate.

14. The invention according to claim 13, and a pair of guide rails on opposite sides of plates for slidably supporting said bottom plate.

15. The invention according to claim 14, and means on said hopper for limiting edgewise movement of the upper plate and guiding the upper plate in a lifting direction thereof.

16. The invention according to claim 15, and releasable means for holding the plates in released and in the closed position thereof.

* * * * *